US010378186B2

(12) United States Patent
Hiromatsu et al.

(10) Patent No.: US 10,378,186 B2
(45) Date of Patent: Aug. 13, 2019

(54) CONSTRUCTION MACHINE

(71) Applicant: HITACHI CONSTRUCTION MACHINERY CO., LTD., Tokyo (JP)

(72) Inventors: Kohei Hiromatsu, Ushiku (JP); Shiho Izumi, Hitachinaka (JP); Yasuhiko Kanari, Kasumigaura (JP); Daito Sakai, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 45 days.

(21) Appl. No.: 15/846,292

(22) Filed: Dec. 19, 2017

(65) Prior Publication Data

US 2018/0282977 A1 Oct. 4, 2018

(30) Foreign Application Priority Data

Mar. 29, 2017 (JP) ..... 2017-066047

(51) Int. Cl.
*E02F 9/26* (2006.01)
*E02F 3/43* (2006.01)
(Continued)

(52) U.S. Cl.
CPC ..... *E02F 9/264* (2013.01); *E02F 3/32* (2013.01); *E02F 3/435* (2013.01); *E02F 9/20* (2013.01)

(58) Field of Classification Search
CPC ..... E02F 3/32; E02F 3/435; E02F 9/20; E02F 9/264
See application file for complete search history.

(56) References Cited

U.S. PATENT DOCUMENTS 9,644,346 B2 * 5/2017 Seki ..... E02F 9/264
2013/0066527 A1 3/2013 Mizuochi et al.
(Continued)

FOREIGN PATENT DOCUMENTS

JP 5823046 B 11/2015
KR 10-0858632 B1 9/2008
(Continued)

OTHER PUBLICATIONS

Korean Office Action received in corresponding Korean Application No. 10-2017-0162966 dated Oct. 29, 2018.

*Primary Examiner* — Tyler J Lee
(74) *Attorney, Agent, or Firm* — Mattingly & Malur, PC

(57) ABSTRACT

When a work implement is actuated in such a manner that a work point is located at each of a plurality of positions on a datum line, a first work point position computing section calculates a position of the work point at each of the plurality of positions. A calibration value computing section calculates calibration values of angle conversion parameters (αbm, βbm, αam, βam, αbk, βbk), dimension parameters (Lbm, Lam, Lbk), and line parameters (tilt tan θ, intercept Zline) using the fact that the positions of the work point at each of the plurality of positions calculated by the first work point position computing section can satisfy a linear equation indicating a datum line. A parameter update section reflects the calibration values calculated by the calibration value computing section in computation by a corresponding computing section that is one of the angle computing section and the first work point position computing section.

6 Claims, 9 Drawing Sheets

(51) Int. Cl.
*E02F 9/20* (2006.01)
*E02F 3/32* (2006.01)

(56) References Cited

U.S. PATENT DOCUMENTS

| | | | | |
|---|---|---|---|---|
| 2013/0158789 | A1* | 6/2013 | Seki | E02F 9/264 701/34.4 |
| 2013/0166143 | A1* | 6/2013 | Seki | E02F 9/264 701/34.4 |
| 2014/0107897 | A1* | 4/2014 | Zhu | E02F 3/435 701/50 |
| 2015/0066312 | A1* | 3/2015 | Sakuda | E02F 9/2271 701/50 |
| 2015/0330060 | A1 | 11/2015 | Seki et al. | |
| 2017/0089041 | A1* | 3/2017 | Kawamoto | E02F 9/26 |
| 2018/0171598 | A1* | 6/2018 | Iwamura | E02F 3/434 |
| 2018/0251959 | A1* | 9/2018 | Fujii | E02F 9/20 |
| 2018/0283418 | A1* | 10/2018 | Ishida | F15B 19/002 |

FOREIGN PATENT DOCUMENTS

| | | | |
|---|---|---|---|
| KR | 10-2013-0090763 | A | 8/2013 |
| KR | 10-2016-0003678 | A | 1/2016 |

* cited by examiner

CONSTRUCTION MACHINE

BACKGROUND OF THE INVENTION

1. Field of the Invention

The present invention relates to a construction machine such as a hydraulic excavator having a work implement.

2. Description of the Related Art

A construction machine such as a hydraulic excavator has a work implement configured with a plurality of front implement members such as a boom, an arm, and a bucket (work tools), and a travel device for moving the construction machine, and an operator can actuate the work implement and the travel device by operating operation levers.

Work by the construction machine at a construction site is determined by a design drawing or the like. Since it is difficult to carry out operation as intended only by a judgment of situation based on an operator's visual check, the operator is instructed in an intended work plane by installing marks such as finishing stakes and tracing tapes on the construction site.

Meanwhile, it takes labor to install many finishing stakes and tracing tapes on a wide construction site and operator's skill is also necessary to pursue construction work as intended. Against this backdrop, a system called machine guidance for providing posture detection means such as angle sensors for front implement members and stroke sensors for hydraulic cylinders in the construction machine, computing a current position of a work point (for example, a claw tip of a bucket) on the basis of detected posture information and dimensions of the work implement, and displaying a distance between the obtained current position of the work point and a target work plane on a screen by a drawing or a numerical value has recently come into widespread use. It is thereby possible for the operator to easily grasp contents of the work.

Accuracy of the computed current position of the work point is influenced by parameters such as the posture information and the dimensions of the work implement described above. Examples of causes of a reduction of the accuracy include changes in characteristics due to an individual difference of the sensors used for posture detection and a secular factor, changes in the posture information due to misalignments of sensor mounting positions during disassembly and reassembly of the work implement, and dimensional changes due to manufacturing errors, backlash, and plastic deformation of the front implement members. Owing to this, it is necessary to maintain the accuracy of computed values by calibrating the aforementioned parameters at regular intervals so that the computed values and true values match with one another for the current position of the work point at a time of shipment of the construction machine, before starting the work, or the like.

To address the need, there has been proposed a technique for setting measurement values measured by an external measuring device as true values and calibrating parameters for a construction machine on the basis of the measurement values (refer to, for example, the specification of Japanese Patent No. 5823046).

SUMMARY OF THE INVENTION

According to the technique described in Japanese Patent No. 5823046, the aforementioned parameters are calibrated using the external measuring device. Generally, however, the external measuring device becomes more expensive as accuracy is higher and expertise is essential for handling. Owing to this, only limited operators can carry out calibration work. Furthermore, the external measuring device is not necessarily installable at whatever site where the construction machine is used and is, therefore, unfavorable for calibration before start of the work.

An object of the present invention is to enable an operator to easily carry out calibration work at every construction site with a view to maintaining accuracy for computing a position of a work point of a construction machine.

The present application includes a plurality of means for attaining the above object. As an example of the means, there is provided a construction machine including: a vehicle main body; a multijoint type work implement that is attached to the vehicle main body and configured with a plurality of front implement members; a plurality of angle sensors that detect angles of the plurality of front implement members respectively; and a controller, the controller including: an angle computing section that calculates angles of the plurality of front implement members on the basis of output signals from the plurality of angle sensors and angle conversion parameters; and a first work point position computing section that calculates a position of a work point arbitrarily set on the work implement on an operation plane of the work implement on the basis of the angles of the plurality of front implement members calculated by the angle computing section and dimension parameters of the plurality of front implement members. In the construction machine, when the work implement is actuated in such a manner that the work point is located at each of a plurality of positions on a linear datum line set on the operation plane, the first work point position computing section calculates a position of the work point at each of the plurality of positions, and the controller includes: a calibration value computing section that calculates calibration values of the angle conversion parameters, the dimension parameters, and a parameter of the datum line on the basis of the position of the work point at each of the plurality of positions calculated by the first work point position computing section; and a parameter update section that reflects the calibration values calculated by the calibration value computing section in computation by a corresponding computing section that is one of the angle computing section and the first work point position computing section.

Advantage of the Invention

According to the present invention, it is possible to maintain accuracy for computing a position of a work point of a construction machine since calibration work can be easily carried out at every construction site.

DESCRIPTION OF THE PREFERRED EMBODIMENTS

A calibration system for a construction machine according to embodiments of the present invention will be described hereinafter with reference to the drawings while taking a hydraulic excavator as an example.

First Embodiment

In a first embodiment, a point laser irradiator 47 (refer to FIG. 5) having a function of measuring a gradient with respect to a horizontal plane is used as a datum line creation device that defines a line (datum line 51) on which a bucket claw tip is located on a construction site or the like.

Figure 1:
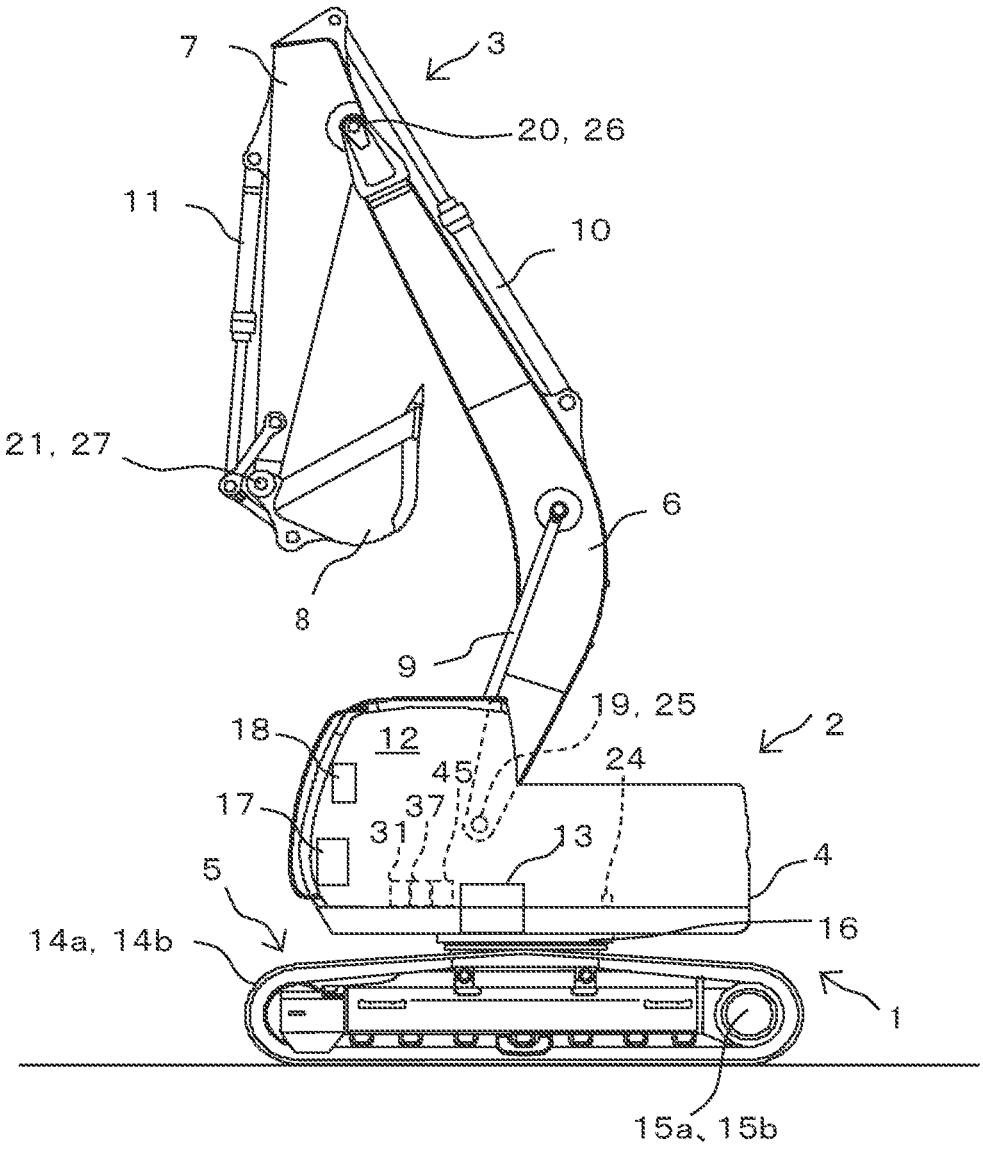
FIG. 1 is a side view of a hydraulic excavator 1 in which a calibration system is mounted.

FIG. 1 is a side view of a hydraulic excavator 1 in which a calibration system is mounted according to the present invention. The hydraulic excavator 1 includes a vehicle main body 2 that has an upper swing structure 4 and a lower travel structure 5, and a multijoint type work implement (front work implement machine) 3 that is attached to the upper swing structure 4 and configured with a plurality of front implement members (link members) 6, 7, and 8.

The work implement 3 includes a boom 6 that is rotatably attached to the upper swing structure 4 via a boom pin 19, an arm 7 that is rotatably attached to a tip end of the boom 6 via an arm pin 20, and a bucket 8 that is rotatably attached to a tip end of the arm 7 via a bucket pin 21. The work implement 3 also includes a boom cylinder 9, an arm cylinder 10, and a bucket cylinder 11 that are hydraulic cylinders (hydraulic actuators) for driving the boom 6, the arm 7, and the bucket 8. In the present specification, the bucket 8 is located on a tip end of the work implement 3 configured with the plurality of front implement members 6, 7, and 8 and is, therefore, often referred to as "tip end front implement member."

The lower travel structure 5 includes a left travel motor 15*a*, a right travel motor 15*b*, and left and right crawler belts (endless tracks) 14*a* and 14*b* driven by the travel motors 15*a* and 15*b*, respectively. The travel motors 15*a* and 15*b* are driven to rotate the crawler belts 14*a* and 14*b*, whereby the hydraulic excavator 1 travels. The lower travel structure 5 is not limited to the crawler type shown in FIG. 1 but may be a wheel type having a plurality of wheels.

The upper swing structure 4 is swingably attached to an upper portion of the lower travel structure 5 via a slewing ring 16 and driven to swing by a swing drive device (swing motor) 13. A cab 12, a hydraulic pump (not shown) delivering a hydraulic working fluid for the hydraulic actuators, a prime mover (for example, an engine or a motor) (not shown) for driving the hydraulic pump, and devices such as computers that include a vehicle body control controller 31, a display controller 37, and a calibration controller 45 are mounted in the upper swing structure 4.

A vehicle body operating device 17 that outputs an operation signal in response to an operation amount and a display device (for example, a liquid crystal display (LCD)) 18 on which various information is displayed are provided in the cab 12. The operation signal is output by operator's operating the vehicle body operating device 17. The boom cylinder 9, the arm cylinder 10, the bucket cylinder 11, the swing drive device 13, and the travel motors 15*a* and 15*b* can be driven on the basis of the operation signal.

In the present embodiment, a device provided with a plurality of levers that include a first operation lever for instructing an operator on raising and lowering of the boom 6 and dumping and crowding of the bucket 8, a second operation lever for instructing the operator on dumping and crowding of the arm 7 and left and right swinging of the upper swing structure 4, a first travel lever for instructing the operator on normal rotation and reverse rotation of the travel motor 15*a*, a second travel lever for instructing the operator on normal rotation and reverse rotation of the travel motor 15*b* (all of which are not shown) is mounted as the vehicle body operating device 17. The first operation lever and the second operation lever are double-compound multifunction operation levers. Operating the first operation lever forward and backward corresponds to the raising and lowering of the boom 6, and operating the first operation lever leftward and rightward corresponds to the crowding and dumping of the bucket 8. Operating the second operation lever forward and backward corresponds to the dumping and crowding of the arm 7, and operating the second operation lever leftward and rightward corresponds to the left and right rotation of the upper swing structure 4. When one lever is operated in an oblique direction, two corresponding actuators operate simultaneously. The first travel lever and the second travel lever are single function operation levers. Operating the first travel lever forward and backward corresponds to the normal rotation and reverse rotation of the travel motor 15*a*, and operating the second travel lever forward and backward corresponds to the normal rotation and reverse rotation of the travel motor 15*b*.

The vehicle body operating device 17 is provided with an operation amount sensor (not shown) that detects operation amounts of the first and second operation levers and the first and second travel levers and that transmits detection signals thereof to the vehicle body control controller 31.

Figure 2:
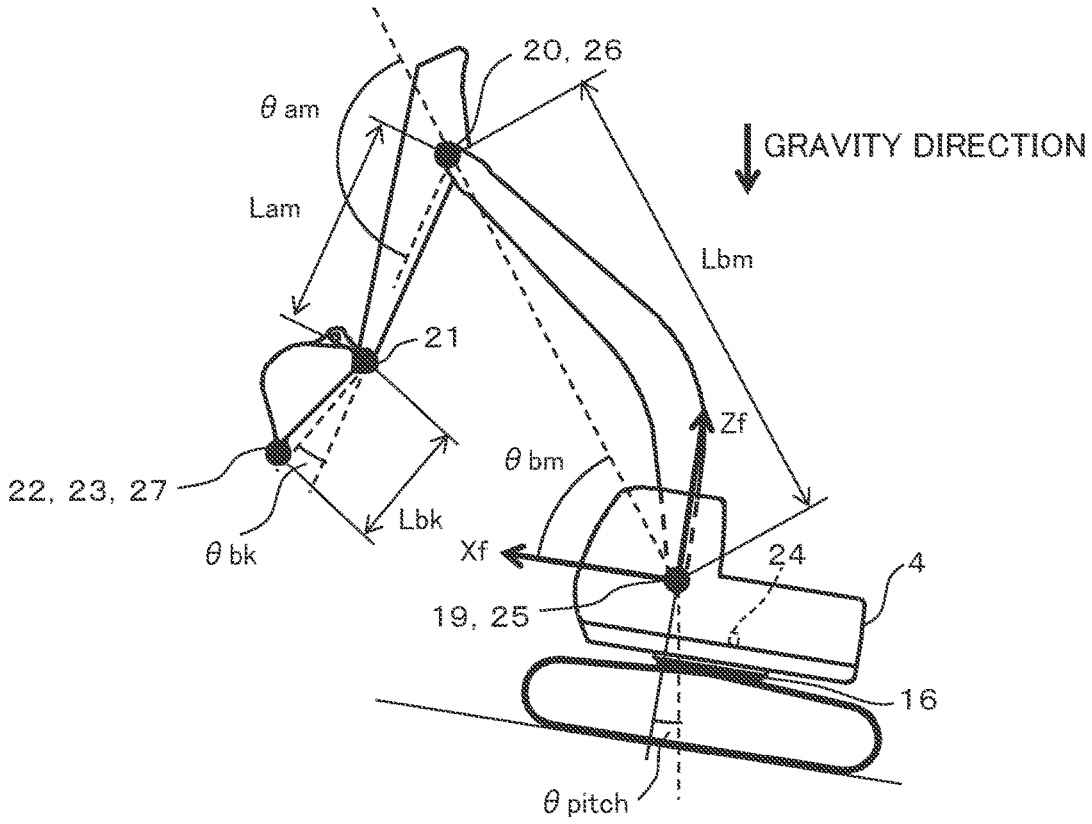
FIG. 2 simply shows a coordinate system and dimensions of the hydraulic excavator 1.

FIG. 2 simply shows a coordinate system and dimensions of the hydraulic excavator 1.

The coordinate system {Xf, Yf, Zf} of the hydraulic excavator 1 sets a center of the boom pin 19 as an origin. A Zf axis is set in parallel to a central axis of the slewing ring 16 and an upward direction is assumed as a positive direction of the Zf axis. An Xf axis is set perpendicular to the Zf axis on a plane (operation plane) on which a bucket claw tip 22 (work point 23) is movable, and a forward direction of the upper swing structure 4 is assumed as a positive direction of the Xf axis. A Yf axis, which is not shown, is set in accordance with a right-handed system. The Yf axis is thereby an axis perpendicular to paper of FIG. 2 and a front side of the paper is assumed as a positive direction of the Yf axis.

A length Lbm of the boom 6 is a length from the boom pin 19 to the arm pin 20, a length Lam of the arm 7 is a length from the arm pin 20 to the bucket pin 21, and a length Lbk of the bucket 8 is a length from the bucket pin 21 to the bucket claw tip 22. It is assumed that a center of the bucket claw tip 22 in a width direction is the work point 23. It is assumed that a counterclockwise direction of the boom 6, the arm 7, and the bucket 8 about the Yf axis is a positive rotation direction thereof. It is noted that the work point 23 may be set to a point other than the center in the width direction as long as the point is a point in the width direction of the bucket 8.

The hydraulic excavator 1 is provided with a first rotation angle sensor 25, a second rotation angle sensor 26, and a third rotation angle sensor 27 as angle sensors that detect angles of the plurality of front implement members 6, 7, and 8 that configure the work implement 3, respectively.

The first rotation angle sensor 25 attached to the upper swing structure 4 is, for example, a rotary potentiometer and detects a relative angle θbm of the boom 6 to the upper swing structure 4 as an analog signal Vbm. The second rotation angle sensor 26 attached to the boom 6 is, for example, a rotary potentiometer and detects a relative angle θam of the arm 7 to the boom 6 as an analog signal Vam. The third rotation angle sensor 27 attached to the arm 7 is, for example, a rotary potentiometer and detects a relative angle θbk of the bucket 8 to the arm 7 as an analog signal Vbk.

A longitudinal tilt angle sensor 24 attached to the upper swing structure 4 is, for example, an inertial measurement unit (IMU) and detects an angle θpitch of the Zf axis with respect to a gravity direction about the Yf axis. It is assumed that a counterclockwise direction of the angle θpitch is a positive direction.

Figure 3:
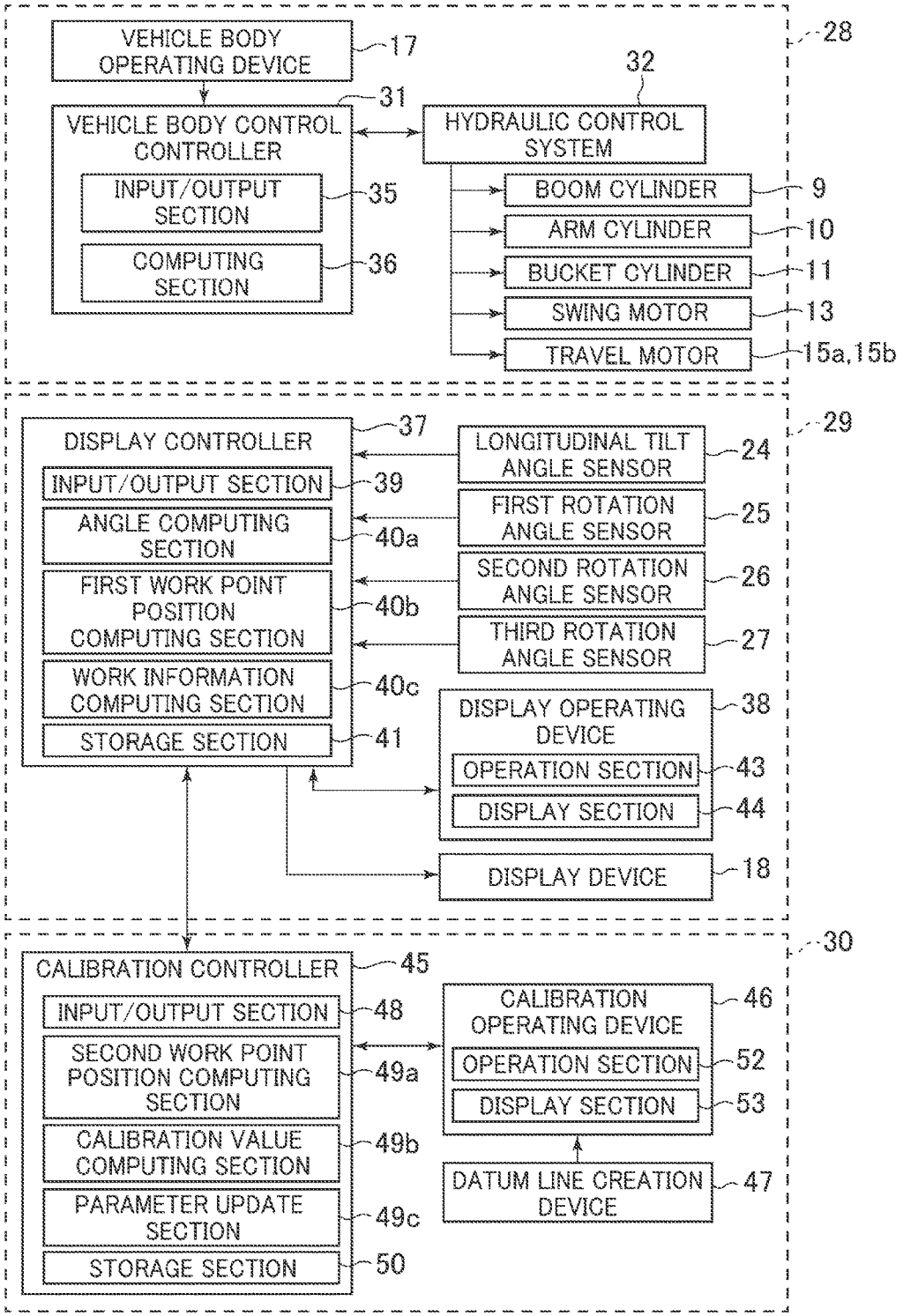
FIG. 3 is a schematic configuration diagram of a vehicle body control system 28, a display system 29, and a calibration system 30 mounted in the hydraulic excavator 1.

FIG. 3 is a schematic configuration diagram of a vehicle body control system 28, a display system 29, and a calibration system 30 mounted in the hydraulic excavator 1.

[Vehicle Body Control System 28]

The vehicle body control system 28 has the vehicle body operating device 17, the vehicle body control controller (controller) 31, a hydraulic control system 32, the boom cylinder 9, the arm cylinder 10, the bucket cylinder 11, the swing motor 13, and the travel motors 15*a* and 15*b*.

The vehicle body control controller 31 is a computer that has an input/output section 35 configured with an A/D converter, a D/A converter, a digital input/output device, or the like, a computing section 36 such as a CPU, and a storage section (not shown) such as a ROM or a RAM.

The input/output section 35 of the vehicle body control controller 31 receives signals input from the vehicle body operating device 17 and the hydraulic control system 32, transmits the signals to the computing section 36, and transmits a computation result of the computing section 36 to the hydraulic control system 32.

The computing section 36 of the vehicle body control controller 31 computes a command value to the hydraulic control system 32 on the basis of the operation amounts transmitted from the operation amount sensor of the vehicle body operating device 17 and a state amount of the hydraulic control system 32.

The hydraulic control system 32 is a system that controls an amount of the hydraulic working fluid allocated to the actuators such as the boom cylinder 9, the arm cylinder 10, the bucket cylinder 11, the swing motor 13, and the travel motors 15*a* and 15*b* for driving the actuators. The hydraulic control system 32 is configured with, for example, the engine, the hydraulic pump driven by the engine, a hydraulic control valve that controls a flow rate and a direction of the hydraulic working fluid supplied to each hydraulic actuator, and the like. The hydraulic control system 32 controls the hydraulic actuators 9 to 11, 13, and 15 on the basis of the command value computed by the vehicle body control controller 31.

[Display System 29]

The display system 29 has the display controller 37, a display operating device 38, the longitudinal tilt angle sensor 24, and the first to third rotation angle sensors 25 to 27.

The display controller 37 is a computer that has an input/output section 39 configured with an A/D converter, a D/A converter, a digital input/output device, or the like, a computing section 40 (40*a*, 40*b*, 40*c*) such as a CPU, and a storage section 41 such as a ROM or a RAM.

The input/output section 39 of the display controller 37 receives operation information input from the display operating device 38, the analog signals (output signals) input from the longitudinal tilt angle sensor 24 and the first to third rotation angle sensors 25 to 27, and calibrated parameters input from the calibration controller 45. The input/output section 39 transmits the operation information, the analog signals (output signals), and the calibrated parameters to the computing section 40 (40*a*, 40*b*, 40*c*). Furthermore, the input/output section 39 transmits a computation result of the computing section 40 (40*a*, 40*b*, 40*c*) to the display operating device 38 and the calibration controller 45.

The computing section 40 of the display controller 37 functions as an angle computing section 40*a*, a first work point position computing section 40*b*, and a work information computing section 40*c* on the basis of a program stored in the storage section 41.

The storage section 41 of the display controller 37 stores angle conversion parameters, vehicle body dimension parameters, and target plane information. The angle conversion parameters include coefficients (αbm, βbm, αam, βam, αbk, and βbk (to be described later)) in equations for converting the analog signals from the first to third rotation angle sensors 25 to 27 into angles. The vehicle body dimension parameters include the length Lbm of the boom 6, the length Lam of the arm 7, and the length Lbk of the bucket 8 described above. The target plane information includes at least one coordinate information on a cross-section of a plane on which the hydraulic excavator 1 carries out work on an Xf-Zf plane.

[Angle computing section 40*a*] The angle computing section 40*a* converts the analog signals Vbm, Vam, and Vbk input to the input/output section 39 from the first to third rotation angle sensors 25 to 27 into angles θbm, θam, and θbk. For example, computation for converting the analog signals Vbm, Vam, and Vbk into the angles θbm, θam, and θbk is performed using linear equations. The angle computing section 40*a* according to the present embodiment calculates the angles θbm, θam, and θbk as represented by the following Equations (1) to (3) on the basis of the analog signals Vbm, Vam, and Vbk from the first to third rotation angle sensors 25 to 27 and the angle conversion parameters αbm, βbm, αam, βam, αbk, and βbk stored in the storage section 41 for converting these analog signals into the angles θbm, θam, and θbk.

$$\theta bm=\alpha bm\times Vbm+\beta bm \quad (1)$$

$$\theta am=\alpha am\times Vam+\beta am \quad (2)$$

$$\theta bk=\alpha bk\times Vbk+\beta bk \quad (3)$$

[First Work Point Position Computing Section 40*b*]

The first work point position computing section 40*b* computes a position Pd=[Xd, Yd, Zd] of the work point 23 in the coordinate system {Xf, Yf, Zf} of the hydraulic excavator 1. The first work point position computing section 40*b* executes this computation as represented by the following Equations (4) to (6) on the basis of the angles (θbm, θam, and θbk) computed by the angle computing section 40*a* and the vehicle body dimension parameters (Lbm, Lam, and Lbk) stored in the storage section 41. In the present specification, the coordinates [Xd, Yd, Zd] of the work point 23 computed by the first work point position computing section 40*b* are often referred to as a first Xf coordinate, a first Yf coordinate, and a first Zf coordinate to distinguish the coordinates [Xd, Yd, Zd] from coordinates of the work point 23 computed by a second work point position computing section 49*b* to be described later.

$$Xd=Lbm\times\cos(\theta bm)+Lam\times\cos(\theta bm+\theta am)+Lbk\times\cos(\theta bm+\theta am+\theta bk) \quad (4)$$

$$Yd=0 \quad (5)$$

$$Zd=-\{Lbm\times\sin(\theta bm)+Lam\times\sin(\theta bm+\theta am)+Lbk\times\sin(\theta bm+\theta am+\theta bk)\} \quad (6)$$

The work information computing section 40*c* computes numerical information and display information indicating a position relationship between the work point 23 and a target plane on the basis of the operation information from the display operating device 38, a computation result of the first work point position computing section 40*b*, and the target plane information stored in the storage section 41.

The display operating device 38 has an operation section 43 and a display section 44. The operation section 43 is, for example, a switch. By operating this switch, the operator performs a changeover of the display information displayed on the display device 18 and a setting of the target plane information stored in the storage section 41 of the display controller 37. The display section 44 is, for example, a liquid crystal display and the computation result of the computing section 40 is displayed on the display section 44 so that the operator confirms contents of the work.

[Calibration System 30]

The calibration system 30 is a system that calibrates the first to third rotation angle sensors 25 to 27 by calibrating the parameters (angle conversion parameters, dimension parameters, and the like) used by the angle computing section 40*a* and the first work point position computing section 40*b* at a time of computing the position of the work point 23. The calibration system 30 includes the calibration controller 45, a calibration operating device 46, and a datum line creation device 47.

[Datum Line Creation Device 47]

Figure 5:
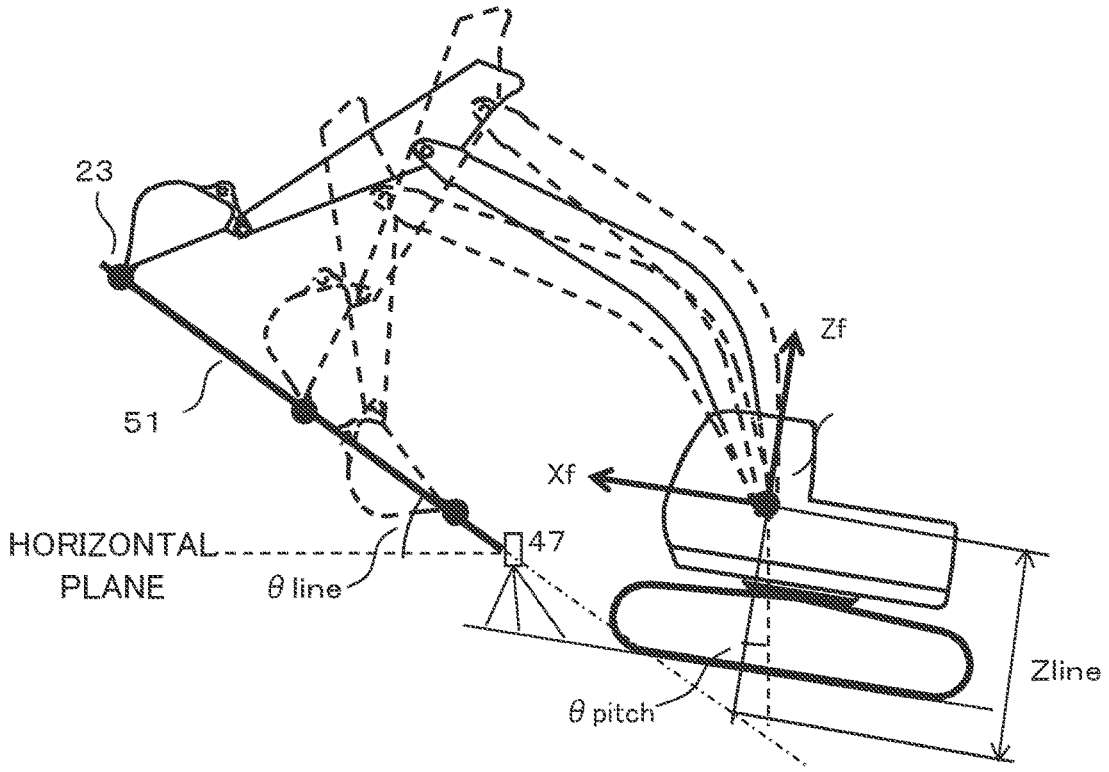
FIG. 5 is a side view of the hydraulic excavator 1 that assumes three types of calibration postures according to the first embodiment.

The datum line creation device 47 is a device that creates the datum line 51 which is the line on which the work point 23 is located at a time of calibration work and that can acquire an angle θline of the datum line 51 with respect to a horizontal plane as shown in FIG. 5. For example, a point laser irradiator having the function of measuring a gradient with respect to the horizontal plane can be used as the datum line creation device 47. A radiated laser beam may be not only a point laser beam but also a line laser beam. If the laser beam is the latter, the datum line 51 is always visible from the operator within the cab 12, so that the work point 23 can be easily located on the datum line 51. In the present embodiment, the datum line creation device 47 is fixed onto a ground by a tripod and creates the datum line 51 as shown in FIG. 5. A tilt of the datum line 51 with respect to the Xf-Zf plane defined for the hydraulic excavator 1 is defined by a tangent (tan(θline−θpitch)) of a difference between θpitch detected by the tilt angle sensor 24 and θline.

The calibration operating device 46 has an operation section 52 and a display section 53. The operation section 52 is, for example, a switch. By operating this switch, the operator performs a changeover of the display information displayed on the display device 18, a setting and an update of the angle conversion parameters and the vehicle body dimension parameters stored in the storage section 41 of the display controller 37, a setting of information on the datum line 51 stored in a storage section 50 of the calibration controller 45, a confirmation when the hydraulic excavator 1 assumes a calibration posture for locating the work point 23 on the datum line 51, and the like. The display section 53 is, for example, a liquid crystal display or a loudspeaker, and displays contents of the calibration work procedures and a computation result of a computing section 49 shown to the operator.

[Calibration Controller 45]

The calibration controller 45 is a computer that has an input/output section 48 such as a digital input/output device, the computing section 49 such as a CPU, and the storage section 50 such as a ROM or a RAM.

The computation result of the computing section 40 of the display controller 37, and the angle conversion parameters, the vehicle body dimension parameters, and the like stored in the storage section 41 of the display controller 37 are input to the input/output section 48 of the calibration controller 45. The input/output section 48 transmits the input computation result and parameters to the computing section 49. Furthermore, the input/output section 48 transmits a computation result of the computing section 49 to the display controller 37 as appropriate to display the computation result on the display device 18.

The storage section 50 of the calibration controller 45 stores the datum line information. The datum line information is information necessary to define the datum line 51 on the Xf-Zf plane. The datum line information includes an equation (linear equation for Xf and Zf (refer to Equation (11)) indicating the datum line 51 on the Xf-Zf plane, and line parameters including the tilt (tan θ)) and an intercept (Zline) of the datum line 51 on the Xf-Zf plane. As the datum line 51, an arbitrary line can be selected on the Xf-Zf plane if the front work implement 3 can be moved so that the work point 23 is located at a plurality of positions on the datum line 51. The datum line information according to the present embodiment includes the angle θline of the datum line 51 with respect to the horizontal plane about the Yf axis. A counterclockwise direction of the angle θline about the Yf axis is assumed as a positive direction and the angle θline can be acquired from an output from the datum line creation device 47.

The computing section 49 of the calibration controller 45 functions as the second work point position computing section 49*a*, a calibration value computing section 49*b*, and a parameter update section 49*c* on the basis of a program stored in the storage section 50.

[Second Work Point Position Computing Section 49*a*]

The second work point position computing section 49*a* is a section that calculates a second Zf coordinate of the work point 23 by inputting the first Xf coordinate of the work point 23 calculated by the first work point position computing section 40*b* when the work point 23 is located at an arbitrary point (referred to as "datum point") on the datum line 51 into the equation (linear equation for Xf and Zf) indicating the datum line 51.

[Calibration Value Computing Section 49*b*]

The calibration value computing section 49*b* is a section that calculates calibration values of arbitrary parameters included in the angle conversion parameters, the dimension parameters, and the line parameters on the basis of coordinate values (first Xf coordinates, first Zf coordinates) of the work point 23 at a plurality of datum points calculated by the first work point position computing section 40*b* and the equation (linear equation for Xf and Zf) indicating the datum line 51. More specifically, the calibration value computing section 49*b* calibrates the calibration values of the above-mentioned parameters using the fact that the coordinate values (first Xf coordinates, first Zf coordinates) of the work point 23 at the plurality of datum points calculated by the first work point position computing section 40*b* can satisfy the equation (linear equations for Xf and Zf) indicating the datum line 51. In the present embodiment, the calibration value computing section 49*b* calculates the calibration values of the angle conversion parameters αbm, βbm, αam, βam, αbk, and βbk and the calibration value of the intercept Zline of the datum line 51.

[Parameter Update Section 49*c*]

The parameter update section 49*c* is a section that performs a process for reflecting the calibration values of the arbitrary parameters calculated by the calibration value computing section 49*b* in computation by the corresponding computing section 40 out of the angle computing section 40*a* and the first work point position computing section 40*b*.

[Flowchart of Calibration Process]

Figure 4:
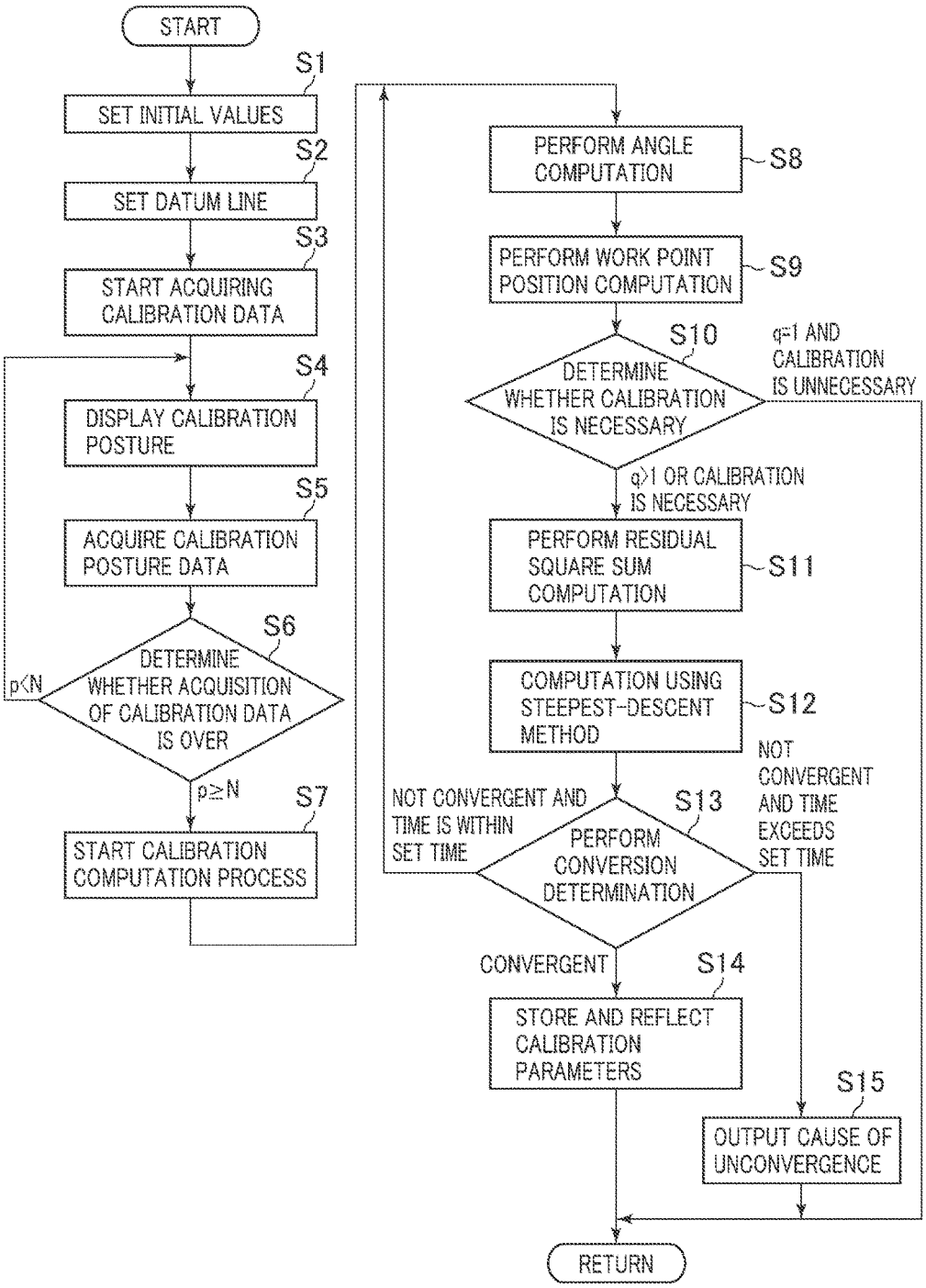
FIG. 4 is a flowchart of a calibration process according to a first embodiment.

FIG. 4 is a flowchart of a calibration process according to the first embodiment, and shows an example of a computation process when the parameters to be calibrated are assumed as the angle conversion parameters α bm, βbm, αam, βam, αbk, and βbk.

First, in Step S1, the computing section 49 sets initial values of α bm, βbm, αam, βam, αbk, and βbk. The set initial values are theoretical values of the angle conversion parameters obtained from specified values, an assembly drawing, and the like of the first to third rotation angle sensors 25 to 27. It is noted that Step S1 can be omitted if the values of α bm, βbm, αam, βam, αbk, and βbk are already set.

In Step S2, the computing section 49 displays on the display device 18 a message for urging the operator to input the angle θline of the datum line 51 with respect to the horizontal plane obtained from the datum line creation device 47. The operator inputs the angle θline via the operation section 52 of the calibration operating device 46, and the computing section 49 acquires the tilt angle θpitch of the vehicle body Zf axis with respect to the gravity direction about the Yf axis at this time from the longitudinal tilt angle sensor 24.

In Step S3, the computing section 49 starts repetition processes of Steps S4 to S6 for acquiring measurement values in a plurality of calibration postures. The number N of the repetition processes needs to be at least equal to the number of the parameters for which the calibration values are calculated. In the present embodiment, the number N may satisfy N≥7 since the parameters for which the calibration values are calculated are the six angle conversion parameters and one Zf intercept of the datum line 51. In the present embodiment, it is assumed that N=7.

In Step S4, the computing section 49 displays on the display device 18 a message for urging the operator to cause the work implement 3 to assume a calibration posture and to operate the operation section 52 in the state. The calibration posture is an arbitrary posture of the work implement 3 for locating the work point 23 on the datum line 51.

FIG. 5 is a side view of the hydraulic excavator 1 that assumes three types of calibration postures. In all the calibration postures in FIG. 5, the work point 23 is located on the datum line 51. All the N calibration postures assumed by the work implement 3 should differ from one another.

Figure 6:
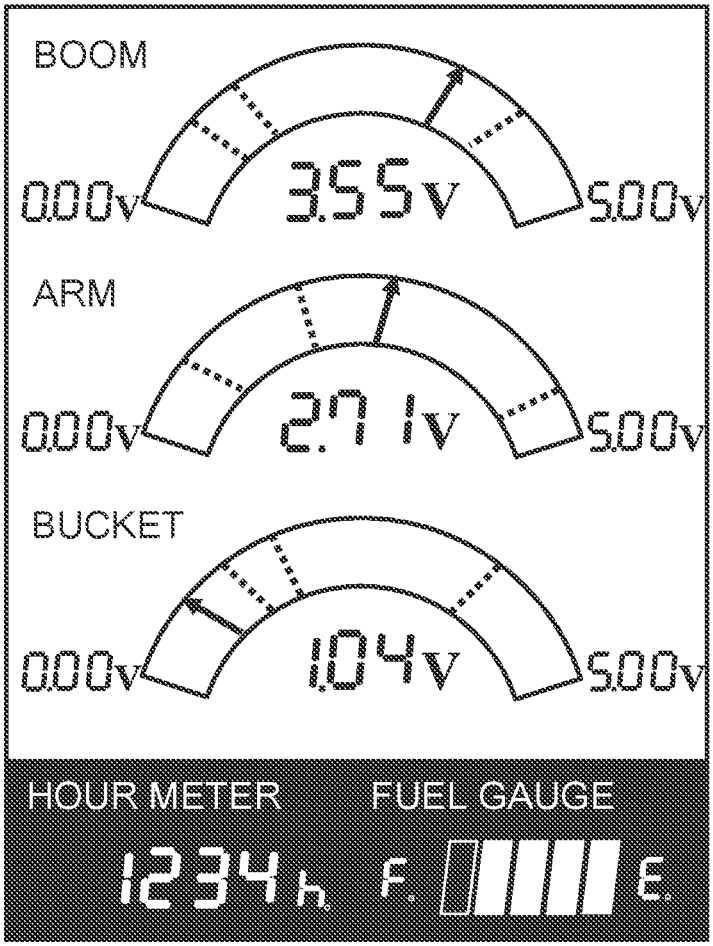
FIG. 6 shows a display example of a display device 18 that assists an operator in operating when the operator causes a work implement 3 to assume a calibration posture.

FIG. 6 shows a display example of display of the display device 18 that assists the operator in operating when the operator operates the operating device 17 to cause the work implement 3 to assume a calibration posture in Step S4. On this display screen, all of output values (voltage values) of the analog signals Vbm[p], Vam[p], and Vbk[p] from the first to third rotation angle sensors 25 to 27 acquired by actuating the work implement 3 so that the work point 23 is located at the plurality of positions on the datum line 51 during the previous repetition processes of Steps S4 to S6 are displayed. Even if one of the boom 6, the arm 7, and the bucket 8 is not driven, the work implement 3 can take all the different calibration postures. Nevertheless, if the boom 6, the arm 7, and the bucket 8 are largely moved in respective movable ranges, it is possible to optimize the calibration result in the entire movable ranges. Owing to this, as shown in FIG. 6, the voltage values of the analog signals from the first to third rotation angle sensors 25 to 27 acquired in the previous repetition processes are displayed on analog gauges from 0 to 5 volts in broken lines, while current voltage values of the analog signals are displayed on the gauges in arrows and displayed digitally in lower portions of the gauges. The display device 18 thereby assists in making the postures of the boom 6, the arm 7, and the bucket 8 different in the N calibration postures.

In Step S5, the operator operates the operation section 52 at timing at which the operator operates the vehicle body operating device 17 to drive the boom 6, the arm 7, and the bucket 8 to assume the calibration posture. With operator's operating the operation section 52 as a trigger, the computing section 49 measures the analog signals Vbm[p], Vam[p], Vbk[p] from the first to third rotation angle sensors 25 to 27 in a p-th (1≤p≤N) repetition process.

In Step S6, the computing section 49 determines whether the repetition process starting at Step S3 has been performed the N times. When determining that the repetition process has been performed the N times, the computing section 49 ends the repetition processes and proceeds to Step S7; otherwise, the computing section 49 increments p by 1, returns to Step S4, and continues the repetition processes.

In Step S7, the computing section 49 starts repetition processes of Steps S8 to S13 for obtaining the parameters and the Zf intercept of the datum line 51 to be calibrated by a nonlinear least-squares method. The repetition processes are continued until a condition to be described later is satisfied.

In Step S8, the angle computing section 40*a* performs angle computation, as represented by Equations (1) to (3), on the measurement values of the analog signals from the first to third rotation angle sensors 25 to 27 for the N times, thereby obtaining angle computed values θbm[p], θam[p], and θbk[p] (1≤p≤N) of the boom 6, the arm 7, and the bucket 8.

In Step S9, the first work point position computing section 40*b* performs work point position computation, as represented by Equations (4) and (6), on the angle computed values for the N times in Step S8, thereby obtaining work point position computed values Xd[p] and Zd[p] (1≤p≤N) on the Xf-Zf plane.

In Step S10, the second work point position computing section 49*b* determines whether calibration is necessary. Determination whether calibration is necessary can be omitted once the second work point position computing section 49*b* determines that calibration is "necessary." When an error of the work point position computed values that are supposed to be present on the datum line 51 from the coordinates of the datum line 51 is large, the second work point position computing section 49*b* determines that calibration is necessary. When the error is small, the second work point position computing section 49*b* determines that calibration is unnecessary. The determination whether calibration is necessary in Step S10 will be described in detail below.

A linear equation that indicates probable values of a point (Xb, Zb) on the datum line 51 on the Xf-Zf plane is represented by the following Equation (11). In Equation (11), it is assumed that Zline is the Zf intercept of the datum line 51 on the Xf-Zf plane shown in FIG. 5, and that initial values of the point (Xb, Zb) are (Xb, Zb)=(Xd[1], Zd[1]), which are numerical values obtained by rearranging Equation (11).

$$Zb=\tan(\theta line-\theta pitch)\times Xb+Zline \tag{11}$$

The second work point position computing section 49*b* calculates the second Zf coordinate by inputting the first Xf coordinate (Xd[p]) into Equation (11) for every p ($1\leq p\leq N$).

When it is assumed that a permissible height error of the work point position computed value is ΔZ and the following Expression (12) is satisfied for every p ($1\leq p\leq N$) (that is, when a magnitude of a difference between the first Zf coordinate (Zd[p]) and the second Zf coordinate does not exceed ΔZ), then the second work point position computing section 49*b* determines that calibration is unnecessary and the computing section 49 ends the flowchart of FIG. 4. Conversely, when Expression (12) is not satisfied for some p, then the second work point position computing section 49*b* determines that calibration is necessary, the computing section 49 proceeds to Step S11, and the calibration value computing section 49*c* computes the calibration values.

$$\Delta Z\geq|Zd[p]-(\tan(\theta line-\theta pitch)\times Xd[p]+Zline)| \tag{12}$$

In Steps S11 to S13, the calibration value computing section 49*c* calculates the angle conversion parameters and the Zf intercept of the datum line 51 to be calibrated by numerical analysis in such a manner that an evaluation value ("evaluation equation F" to be described later) indicating a dissociation degree (separation degree) between the first Zf coordinate and the second Zf coordinate at the same datum point on the datum line 51 can be minimized. Processes in Steps S11 to S13 will be described in detail below.

In Step S11, the calibration value computing section 49*c* obtains the evaluation function F for the work point position computed value (first Zf coordinate) and the datum line 51 (second Zf coordinate). The evaluation function F is assumed as a residual square sum between the work point position computed value and the datum line 51, and the calibration value computing section 49*c* executes the following Equation (13).

$$F=\sum_{k=1}^{N}\{Zd[p]-(\tan(\theta line-\theta pitch)\times Xd[p]+Zline)\}^2 \tag{13}$$

In Step S12, the calibration value computing section 49*c* performs computation for updating the angle conversion parameters and the Zf intercept of the datum line 51 to be calibrated in such a manner that the evaluation function F can be minimized. The calibration value computing section 49*c* is assumed to use, for example, a steepest-descent method. The parameters and the Zf intercept of the datum line 51 to be calibrated in a q-th ($1\leq q$) repetition process are collected into a vector V[q]=[α bm βbm αam βam αbk βbk Zline]. The calibration value computing section 49*c* executes the following Equation (14) to obtain a Jacobian J from the residual square sum F and the vector V[q].

$$J=\left[\frac{\partial F}{\partial\alpha bm}\ \frac{\partial F}{\partial\beta bm}\ \frac{\partial F}{\partial\alpha am}\ \frac{\partial F}{\partial\beta am}\ \frac{\partial F}{\partial\alpha bk}\ \frac{\partial F}{\partial\beta bk}\ \frac{\partial F}{\partial Zline}\right] \tag{14}$$

Each partial derivative is computed by a discretization scheme such as a difference method. The calibration value computing section 49*c* executes the following Equation (15) to obtain an updated vector V[q+1] used in a next repetition process from the Jacobian J and a learning rate η (η>0) that is a parameter for determining a convergence speed.

$$V[q+1]=V[q]-\eta J \tag{15}$$

In Step S13, the calibration value computing section 49*c* performs convergence determination. While assuming that elements in the vector V[q] are vk[q] ($1\leq k\leq 7$) and a convergence determination threshold is TV, the calibration value computing section 49*c* executes the following Expression (16).

$$\tau v\leqq\sum_{k=1}^{7}(vk[q+1]-vk[q])^2 \tag{16}$$

When a condition of Expression (16) is satisfied, the computing section 49 proceeds to Step S14. Conversely, when the condition of Expression (16) is not satisfied and time of the repetition processes exceeds set time, the computing section 49 proceeds to Step S15. Otherwise, the computing section 49 increments q by 1, returns to Step S8, and continues the repetition processes.

In Step S14, the parameter update section 49*c* extracts the calibrated parameters α bm, βbm, αam, βam, αbk, and βbk from the convergent vector V[q+1], stores the calibrated parameters in the storage section 41 of the display controller 37 via the input/output section 48 of the calibration controller 45, and reflects the calibrated parameters in Computing Equations (1) to (3) used by the angle computing section 40*a*, and the computing section 49 ends the flowchart of FIG. 4.

In Step S15, the computing section 49 determines that the vector V[q+1] is not convergent, determines a cause of non-convergence from a computation result of a last repetition process. When a coping method is discovered from the determined cause, the computing section 49 displays the coping method on the display section 53 of the calibration operating device 46, and ends the flowchart of FIG. 4.

[Operations and Effects]

When it is necessary to carry out the calibration work on the angle sensors 25 to 27 in the hydraulic excavator 1 configured as described above, the operator first installs the datum line creation device 47 on the construction site or the like, creates the datum line 51 in a range in which the claw tip 22 of the bucket 8 reaches the datum line 51, and acquires the angle θline that is the gradient of the datum line 51. When the operator gets on board in the hydraulic excavator 1 and inputs the angle θline of the datum line 51 via the operation section 52, the tilt (gradient) of the datum line 51 on the Xf-Zf plane is defined by the difference between this angle θline and the tilt angle θpitch detected by the longitudinal tilt angle sensor 24.

Subsequently, the operator operates the operation section 52 in a state in which the operator operates the vehicle body operating device 17 and thereby operates the work implement 3 to locate the claw tip 22 (work point 23) on the datum line 51, and the computing section 49 measures the analog signals Vbm, Vam, and Vbk output from the angle sensors 25 to 27. Determination whether the work point 23 is present on the datum line 51 is performed by operator's visually confirming whether a point laser beam emitted from the datum line creation device 47 is radiated on the work point 23 on the bucket 8. This determination is repeated the seven times (N times) in the different calibration postures. At that time, by operator's referring to the screen of FIG. 6 displayed on the display device 18, it is possible to make the postures of the boom 6, the arm 7, and the bucket 8 different among the seven calibration postures.

When seven analog signal measurements are over, the calibration controller 45 calculates the calibration values of the angle conversion parameters α bm, βbm, αam, βam, αbk, and βbk and the intercept Zline by performing the numerical analysis in such a manner that the error between the coordinate value (first Zf coordinate) of the work point 23 and the linear equation (second Zf coordinate) indicating the datum line 51 is closer to zero. The parameters used by the angle computing section 40*a* are then updated to the calculated calibration values and the calibration is automatically completed.

As described so far, according to the present embodiment, the work point 23 is made to be located at the plurality of datum points on the datum line 51, whereby the numerical analysis is performed in such a manner that the error between the coordinate value of the work point 23 and the linear equation indicating the datum line 51 is closer to zero and the parameters are automatically calibrated. Therefore, it is possible to greatly shorten calibration work time without the need of measurement and the like of the coordinates of the position of the work point 23 during the calibration work.

Moreover, according to the present embodiment, a single operator can carry out work for installing the datum line creation device 47 and work for locating the work point 23 at the plurality of datum points on the datum line 51 without delay. Therefore, operators supposed to be involved in the calibration can be deployed to other work, which can contribute to improving work efficiency on the entire construction site.

Second Embodiment

A second embodiment of the present invention will next be described. The second embodiment differs from the first embodiment in that not only the gradient of the datum line 51 created by the datum line creation device 47 but also the position thereof is known.

Figure 7:
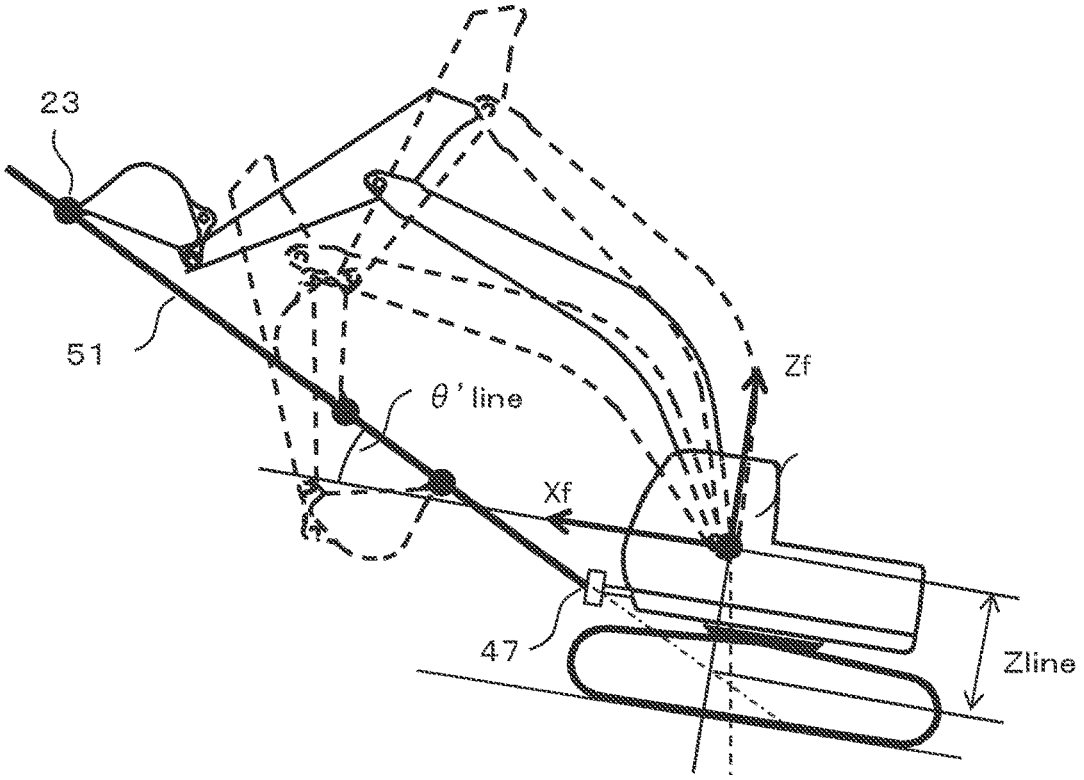
FIG. 7 is a side view of the hydraulic excavator 1 according to a second embodiment.

FIG. 7 is a side view of the hydraulic excavator 1 according to the second embodiment. The datum line creation device 47 according to the present embodiment is the point laser irradiator similar to the datum line creation device 47 according to the first embodiment. However, the datum line creation device 47 according to the present embodiment is fixed to the hydraulic excavator 1 via a jig attached to the hydraulic excavator 1. The datum line creation device 47 is thereby always present at a fixed position in a fixed posture in the coordinate system {Xf, Yf, Zf} of the hydraulic excavator 1. Owing to this, an angle θ'line of the datum line 51 (that is, a tilt of the datum line 51) with respect to the Xf axis about the Yf axis on the Xf-Zf plane and the Zf intercept Zline are known as the datum line information. The present embodiment can, therefore, facilitate computing the calibration values, compared with the first embodiment.

A hardware configuration of the hydraulic excavator 1 according to the present embodiment is the same as that according to the first embodiment except for the above respect. Differences of the hydraulic excavator 1 according to the present embodiment from that according to the first embodiment will be described below. The parameters to be calibrated in the present embodiment are assumed as the angle conversion parameters α bm, βbm, αam, βam, αbk, and βbk similarly to the first embodiment, and a flow of the flowchart is the same as that shown in FIG. 4. Here, processes (steps) in the flowchart different from those according to the first embodiment will be mainly described with reference to FIG. 4, while it is assumed that processes (steps) not described below are performed similarly to those according to the first embodiment.

In Step S2, the computing section 49 inputs therein the operator inputs the angle θ'line of the datum line 51 with respect to the coordinate system of the hydraulic excavator 1 and the Zf intercept Zline of the datum line 51 that are stored in the storage section 50 in advance.

In Step S3, the computing section 49 starts repetition processes of Steps S4 to S6 for acquiring measurement values in a plurality of calibration postures. In the present embodiment, the number N may satisfy N≥6 since the parameters for which the calibration values are calculated are the six angle conversion parameters. In the present embodiment, it is assumed that N=6.

In Step S10, the second work point position computing section 49*b* determines whether calibration is necessary. The determination whether calibration is necessary in Step S10 according to the present embodiment will be described in detail below.

A linear equation that indicates probable values of the point (Xb, Zb) on the datum line 51 on the Xf-Zf plane is represented by the following Equation (21).

$$Zb=\tan(\theta'\text{line})\times Xb+Z\text{line} \tag{21}$$

When it is assumed that the permissible height error of the work point position computed value is ΔZ and the following Expression (22) is satisfied for every p (1≤p≤N) (that is, when the magnitude of the difference between the first Zf coordinate (Zd[p]) and the second Zf coordinate does not exceed ΔZ), then the second work point position computing section 49*b* determines that calibration is unnecessary and the computing section 49 ends the flowchart of FIG. 4. Conversely, when Expression (22) is not satisfied for some p, then the second work point position computing section 49*b* determines that calibration is necessary, the computing section 49 proceeds to Step S11, and the calibration value computing section 49*c* computes the calibration values.

$$\Delta Z \geq |Zd[p]-(\tan(\theta'\text{line})\times Xd[p]+Z\text{line})| \tag{22}$$

In Step S11, the calibration value computing section 49*c* obtains the evaluation function F for the work point position computed value (first Zf coordinate) and the datum line 51 (second Zf coordinate). The evaluation function F is assumed as the residual square sum between the work point position computed value and the datum line 51, and the calibration value computing section 49*c* executes the following Equation (23).

$$F=\sum_{k=1}^{N}\{Zd[p]-(\tan(\theta'line)\times Xd[p]+Zline)\}^2 \tag{23}$$

In Step S12, the calibration value computing section 49*c* performs computation for updating the angle conversion parameters to be calibrated in such a manner that the evaluation function F can be minimized. The calibration value computing section 49*c* is assumed to use, for example, the steepest-descent method. The parameters to be calibrated in the q-th (1≤q) repetition process are collected into a vector V[q]=[α bm βbm αam βam αbk βbk]. The calibration value computing section 49*c* executes the following Equation (24) to obtain a Jacobian J from the residual square sum F and the vector V[q].

$$J = \left[ \frac{\partial F}{\partial \alpha bm} \quad \frac{\partial F}{\partial \beta bm} \quad \frac{\partial F}{\partial \alpha am} \quad \frac{\partial F}{\partial \beta am} \quad \frac{\partial F}{\partial \alpha bk} \quad \frac{\partial F}{\partial \beta bk} \right] \tag{24}$$

Each partial derivative is computed by the discretization scheme such as the difference method. The calibration value computing section 49*c* executes the following Equation (25) to obtain an updated vector V[q+1] used in the next repetition process from the Jacobian J and the learning rate η (η>0) that is the parameter for determining the convergence speed.

$$V[q+1]=V[q]-\eta J \tag{25}$$

In Step S13, the calibration value computing section 49*c* performs convergence determination. While assuming that elements in the vector V[q] are vk[q] (1≤k≤6) and the convergence determination threshold is TV, the calibration value computing section 49*c* executes the following Expression (26).

$$\tau v \leqq \sum_{k=1}^{6} (vk[q+1] - vk[q])^2 \tag{26}$$

When a condition of Expression (26) is satisfied, the computing section 49 proceeds to Step S14. Conversely, when the condition of Expression (26) is not satisfied and time of the repetition processes exceeds set time, the computing section 49 proceeds to Step S15. Otherwise, the computing section 49 increments q by 1, returns to Step S16, and continues the repetition processes.

In Step S14, the parameter update section 49*c* extracts the calibrated parameters α bm, βbm, αam, βam, αbk, and βbk from the convergent vector V[q+1], stores the calibrated parameters in the storage section 41 of the display controller 37 via the input/output section 48 of the calibration controller 45, and reflects the calibrated parameters in Computing Equations (1) to (3) used by the angle computing section 40*a*, and the computing section 49 ends the flowchart of FIG. 4.

[Effects]

In the hydraulic excavator 1 configured as described so far, the datum line creation device 47 is attached to the hydraulic excavator 1. Owing to this, it takes no labor to install the datum line creation device 47 on the construction site or the like and no labor to input the gradient of the datum line 51 to the calibration controller 45. Furthermore, the number of times of assuming the calibration posture is reduced by one from that according to the first embodiment. It is, therefore, possible to further shorten the calibration work time and further improve the work efficiency, compared with the first embodiment.

Third Embodiment

A third embodiment of the present invention will next be described. The third embodiment differs from the first and second embodiments in that the gradient (tilt) and the position (Zf intercept) of the datum line 51 created by the datum line creation device 47 are both unknown, and in that not only the angle conversion parameters but also the vehicle body dimension parameter is calibrated.

Figure 9:
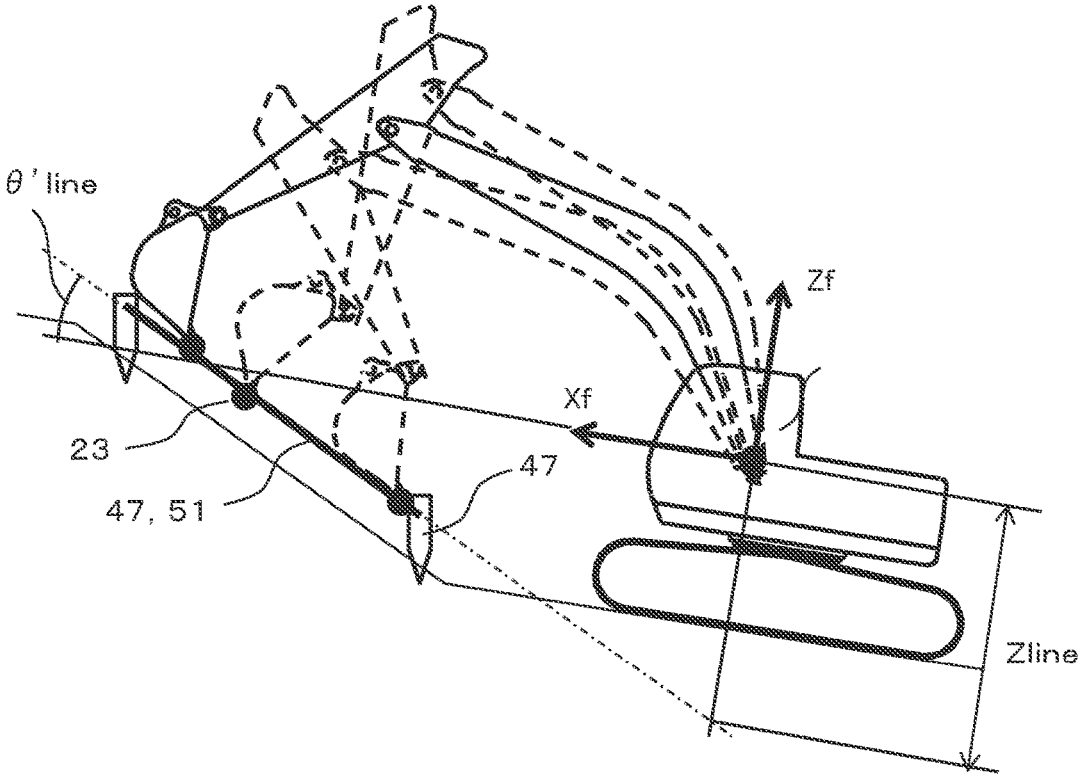
FIG. 9 is a side view of the hydraulic excavator 1 according to a third embodiment.

FIG. 9 is a side view of the hydraulic excavator 1 according to the third embodiment. The datum line creation device 47 is configured with a plurality of piles driven in the ground and a tracing tape tightly stretched between the piles at a desired angle, and this tracing tape serves as the datum line 51. The datum line information that indicates a relationship between the coordinate system {Xf, Yf, Zf} of the hydraulic excavator 1 and the datum line 51 is unknown. A hardware configuration of the hydraulic excavator 1 according to the present embodiment is the same as that according to the first embodiment except for the above respects. A flowchart of the calibration process will be mainly described below.

Figure 8:
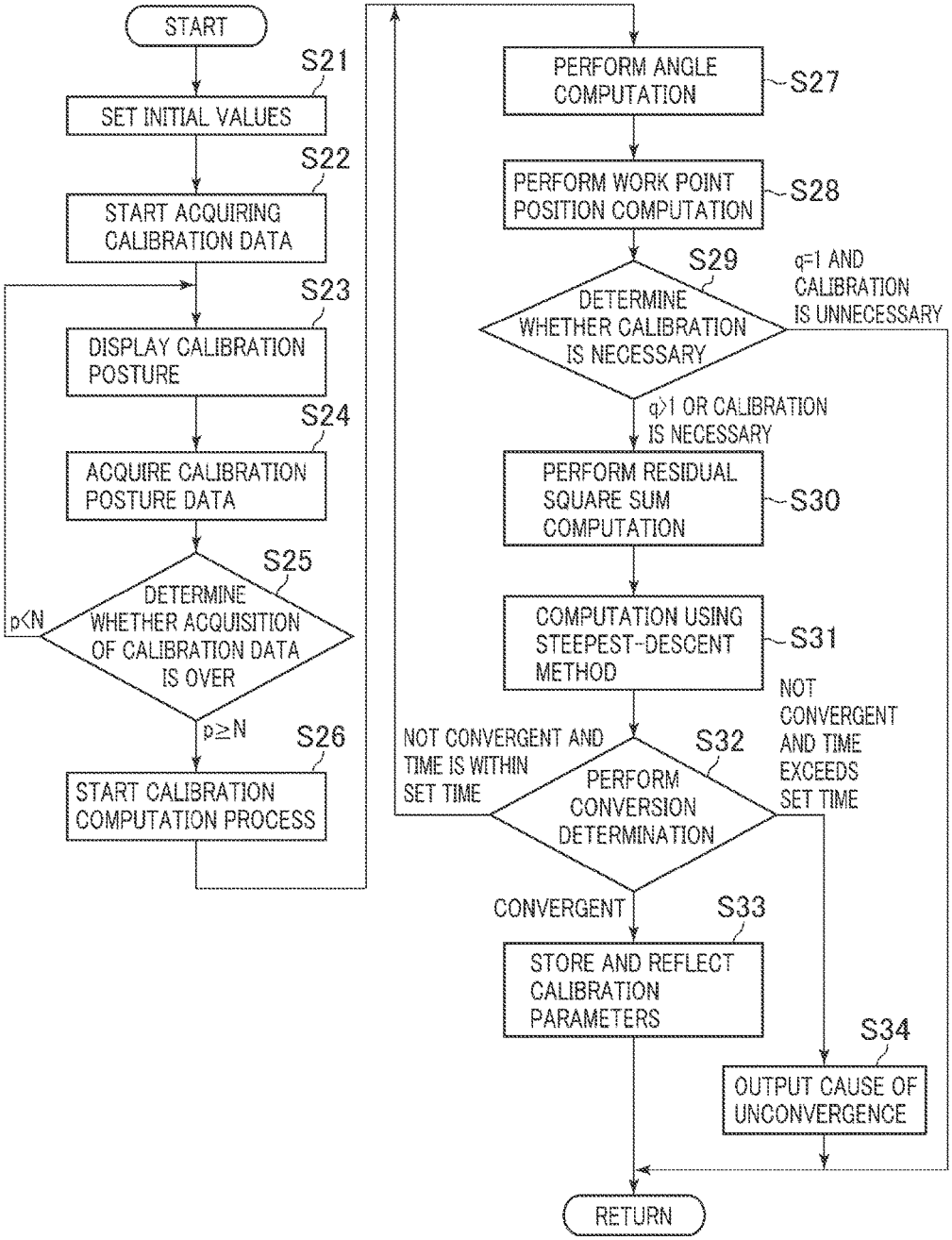
FIG. 8 is a flowchart of a calibration process according to a third embodiment.

FIG. 8 is a flowchart of the calibration process according to the third embodiment for calibrating the third rotation angle sensor 27 and the length Lbk of the bucket 8, and shows an example of a computation process when the parameters to be calibrated are assumed as the angle conversion parameters αbk and βbk, the vehicle body dimension parameter Lbk, and the gradient (θline) and the Zf intercept (Zline) of the datum line 51.

First, in Step S21, the computing section 49 sets initial values of αbk, βbk, and Lbk. The set initial values are theoretical values of the angle conversion parameters obtained from specified values, an assembly drawing, and the like of the third rotation angle sensor 27, and a theoretical value of the vehicle body dimension parameter obtained from a design drawing and the like of the bucket 8. It is noted that Step S21 can be omitted if the values of αbk, βbk, and Lbk are already set.

In Step S22, the computing section 49 starts repetition processes for acquiring measurement values in a plurality of calibration postures. The number N of the repetition processes needs to be at least equal to the number of the parameters to be estimated. In the present embodiment, the number N may satisfy N≥5 since the parameters to be estimated are the parameters to be calibrated and the gradient and the Zf intercept of the datum line 51. In the present embodiment, it is assumed that N=5.

In Step S23, the computing section 49 displays on the display device 18 a message for urging the operator to cause the work implement 3 to assume a calibration posture and to operate the operation section 52 in the state.

In FIG. 9, the work implement 3 assumes three types of calibration postures. All the N calibration postures assumed by the work implement 3 should differ from one another.

In Step S24, the operator operates the operation section 52 at timing at which the operator operates the vehicle body operating device 17 to drive the boom 6, the arm 7, and the bucket 8 to assume the calibration posture. With operator's operating the operation section 52 as a trigger, the computing section 49 measures the analog signals Vbm[p], Vam[p], Vbk[p] from the first to third rotation angle sensors 25 to 27 in a p-th (1≤p≤N) repetition process.

In Step S25, the computing section 49 determines whether the repetition process starting at Step S23 has been performed the N times. When determining that the repetition process has been performed the N times, the computing section 49 ends the repetition processes and proceeds to Step S26; otherwise, the computing section 49 increments p by 1, returns to Step S23, and continues the repetition processes.

In Step S26, the computing section 49 starts repetition processes of Steps S27 to S32 for obtaining the parameters and the Zf intercept of the datum line 51 to be calibrated by the nonlinear least-squares method. The repetition processes are continued until a condition to be described later is satisfied.

In Step S27, the angle computing section 40*a* performs angle computation, as represented by Equations (1) to (3), on the measurement values of the analog signals from the first to third rotation angle sensors 25 to 27 for the N times, thereby obtaining angle computed values θbm[p], θam[p], and θbk[p] (1≤p≤N) of the boom 6, the arm 7, and the bucket 8.

In Step S28, the first work point position computing section 40*b* performs work point position computation, as represented by Equations (4) and (6), on the angle computed values for the N times in Step S27, thereby obtaining work point position computed values Xd[p] and Zd[p] (1≤p≤N) on the Xf-Zf plane.

In Step S29, the second work point position computing section 49*b* determines whether calibration is necessary. Determination whether calibration is necessary can be omitted once the second work point position computing section 49*b* determines that calibration is "necessary." When an error of the work point position computed values that are supposed to be present on the datum line 51 from the coordinates of the datum line 51 is large, the second work point position computing section 49*b* determines that calibration is necessary. When the error is small, the second work point position computing section 49*b* determines that calibration is unnecessary. The determination whether calibration is necessary in Step S29 will be described in detail below.

A linear equation that indicates probable values of a point (Xb, Zb) on the datum line 51 on the Xf-Zf plane is represented by the following Equation (31). In Equation (31), it is assumed that θ'line is the angle of the datum line 51 with respect to the coordinate system of the hydraulic excavator 1 shown in FIG. 9 and Zline is the Zf intercept of the datum line 51 on the Xf-Zf plane shown in FIG. 9, and that initial values of the point (Xb, Zb) are (Xb, Zb)=(Xd[1], Zd[1]) and (Xb, Zb)=(Xd[2], Zd[2]), which are numerical values obtained by substituting the initial values into Equation (31) and solving simultaneous equations and an inverse trigonometric function.

$$Zb=\tan(\theta'\mathrm{line})\times Xb+Z\mathrm{line} \tag{31}$$

The second work point position computing section 49*b* calculates the second Zf coordinate by inputting the first Xf coordinate (Xd[p]) into Equation (31) for every p (1≤p≤N).

When it is assumed that the permissible height error of the work point position computed value is ΔZ and the following Expression (32) is satisfied for every p (1≤p≤N) (that is, when the magnitude of the difference between the first Zf coordinate (Zd[p]) and the second Zf coordinate does not exceed ΔZ), then the second work point position computing section 49*b* determines that calibration is unnecessary and the computing section 49 ends the flowchart of FIG. 8. Conversely, when Expression (32) is not satisfied for some p, then the second work point position computing section 49*b* determines that calibration is necessary, the computing section 49 proceeds to Step S30, and the calibration value computing section 49*c* computes the calibration values.

$$\Delta Z \geqq |Zd[p]-(\tan(\theta'\mathrm{line})\times Xd[p]+Z\mathrm{line})| \tag{32}$$

In Step S30, the calibration value computing section 49*c* obtains the evaluation function F for the work point position computed value (first Zf coordinate) and the datum line 51 (second Zf coordinate). The evaluation function F is assumed as the residual square sum between the work point position computed value and the datum line 51, and the calibration value computing section 49*c* executes the following Equation (33).

$$F=\sum_{k=1}^{N}\{Zd[p]-(\tan(\theta' line)\times Xd[p]+Zline)\}^2 \tag{33}$$

In Step S31, the calibration value computing section 49*c* performs computation for updating the angle conversion parameters and the Zf intercept of the datum line 51 to be calibrated in such a manner that the evaluation function F can be minimized. The calibration value computing section 49*c* is assumed to use, for example, the steepest-descent method. The parameters and the Zf intercept of the datum line 51 to be calibrated in the q-th (1≤q) repetition process are collected into a vector V[q]=[αbk βbk Lbk θ'line Zline]. The calibration value computing section 49*c* executes the following Equation (34) to obtain a Jacobian J from the residual square sum F and the vector V[q].

$$J=\left[\frac{\partial F}{\partial \alpha bk}\quad \frac{\partial F}{\partial \beta bk}\quad \frac{\partial F}{\partial Lbk}\quad \frac{\partial F}{\partial \theta line}\quad \frac{\partial F}{\partial Zline}\right] \tag{34}$$

Each partial derivative is computed by the discretization scheme such as the difference method. The calibration value computing section 49*c* executes the following Equation (35) to obtain an updated vector V[q+1] used in the next repetition process from the Jacobian J and the learning rate η (η>0) that is the parameter for determining the convergence speed.

$$V[q+1]=V[q]-\eta J| \tag{35}$$

In Step S32, the calibration value computing section 49*c* performs convergence determination. While assuming that elements in the vector V[q] are vk[q] (1≤k≤5) and the convergence determination threshold is TV, the calibration value computing section 49*c* executes the following Expression (36).

$$\tau v \leqq \sum_{k=1}^{5}(vk[q+1]-vk[q])^2 \tag{36}$$

When a condition of Expression (36) is satisfied, the computing section 49 proceeds to Step S33. Conversely, when the condition of Expression (36) is not satisfied and time of the repetition processes exceeds set time, the computing section 49 proceeds to Step S34. Otherwise, the computing section 49 increments q by 1, returns to Step S27, and continues the repetition processes.

In Step S33, the parameter update section 49*c* extracts the calibrated parameters αbk, βbk, and Lbk from the convergent vector V[q+1], stores the calibrated parameters in the storage section 41 of the display controller 37 via the input/output section 48 of the calibration controller 45, and reflects the calibrated parameters in Computing Equations (1) to (3) used by the angle computing section 40*a* and Computing Equations (4) to (6) used by the first work point position computing section 40*b*, and the computing section 49 ends the flowchart of FIG. 8.

In Step S34, the computing section 49 determines that the vector V[q+1] is not convergent, determines a cause of non-convergence from a computation result of the last repetition process. When a coping method is discovered from the determined cause, the computing section 49 displays the coping method on the display section 53 of the calibration operating device 46, and ends the flowchart of FIG. 8.

[Effects]

In the hydraulic excavator 1 configured as described so far, it takes no labor to acquire the gradient of the datum line 51 in advance, and the number of times of assuming the calibration posture is reduced by two from that according to the first embodiment. It is, therefore, possible to further shorten the calibration work time and further improve the work efficiency, compared with the first embodiment.

<Features>

Features contained in the three embodiments described above will be summarized.

(1) In each of the above embodiments, a hydraulic excavator includes: a vehicle main body 2; a multijoint type work implement 3 that is attached to the vehicle main body 2 and configured with a plurality of front implement members 6, 7, and 8; a plurality of angle sensors 25, 26, and 27 that detect angles of the plurality of front implement members 6, 7, and 8, respectively; and a display controller 37, the display controller 37 including: an angle computing section 40*a* that calculates angles of the plurality of front implement members 6, 7, and 8 on the basis of output signals from the plurality of angle sensors 25, 26, and 27 and angle conversion parameters (αbm, βbm, αam, βam, αbk, and βbk); and a first work point position computing section 40*b* that calculates a position of a work point 23 arbitrarily set on the work implement 3 on an operation plane (Xf-Zf plane) of the work implement 3 on the basis of the angles of the plurality of front implement members 6, 7, and 8 calculated by the angle computing section 40*a* and dimension parameters (Lbm, Lam, and Lbk) of the plurality of front implement members 6, 7, and 8. In the hydraulic excavator, when the work implement 3 is actuated in such a manner that the work point 23 is located at each of a plurality of datum points on a datum line 51, the first work point position computing section 40*b* calculates a position of the work point 23 at each of the plurality of datum points, and a calibration controller 45 includes: a calibration value computing section 49*b* that calculates calibration values of arbitrary parameters included in the angle conversion parameters (αbm, βbm, αam, βam, αbk, and βbk), the dimension parameters (Lbm, Lam, and Lbk), and line parameters (tilt tan θ, and intercept Zline) using the fact that the position of the work point 23 at each of the plurality of datum points calculated by the first work point position computing section 40*b* can satisfy an equation (linear equation) indicating the datum line 51; and a parameter update section 49*c* that reflects the calibration values of arbitrary parameters calculated by the calibration value computing section 49*b* in computation by a corresponding computing section that is one of the angle computing section 40*a* and the first work point position computing section 40*b*.

(2) More specifically, in the hydraulic excavator 1 according to (1), the first work point position computing section 40*b* calculates a first Xf coordinate and a first Zf coordinate of the work point 23 at each of the plurality of datum points when the work implement 3 is actuated in such a manner that the work point 23 is located at each of the plurality of datum points on the datum line 51, the calibration controller 45 further includes a second work point position computing section 49*a* that calculates a second Zf coordinate of the work point 23 at each of the plurality of datum points by inputting the first Xf coordinate of the work point 23 at each of the plurality of datum points calculated by the first work point position computing section 40*b* into an equation (linear equation) indicating the datum line 51, and the calibration value computing section 49*b* calculates the calibration values of the arbitrary parameters included in the angle conversion parameters, the dimension parameters, and the line parameters in such a manner that an evaluation equation F (evaluation value) indicating a dissociation degree between the first Zf coordinate and the second Zf coordinate at a same datum point among the plurality of datum points is minimized.

If the construction machine is configured as described above, the calibration value computing section 49*b* performs numerical analysis in such a manner that an error between the coordinate value of the work point 23 and the linear equation indicating the datum line 51 is closer to zero and the parameters are automatically calibrated by making the work point 23 to be located at the plurality of datum points on the datum line 51. Therefore, it is possible to greatly shorten calibration work time without the need of measurement and the like of the coordinates of the position of the work point 23 during the calibration work.

(3) In the first embodiment, the hydraulic excavator further includes, in addition to the features described in (2), a tilt angle sensor 24 that calculates a tilt angle θpitch of the vehicle main body 2 with respect to a horizontal plane. The second work point position computing section 49*a* sets a difference between a gradient θline of the datum line 51 with respect to the horizontal plane and the tilt angle θpitch as a tilt of the datum line 51, and calculates the second Zf coordinate of the work point 23 at each of the plurality of datum points from the equation indicating the line the tilt of which is set and from the first Xf coordinate of the work point 23 at each of the plurality of datum points calculated by the first work point position computing section 40*b*, the calibration value computing section 49*b* calculates the calibration value of the angle conversion parameter and an intercept of the datum line 51 in such a manner that the evaluation equation F for the first Zf coordinate and the second Zf coordinate at the same datum point among the plurality of datum points is minimized, and the parameter update section 49*c* reflects the calibration value of the angle parameter calculated by the calibration value computing section 49*b* in computation by the angle computing section 40*a*.

In the construction machine configured as described above, the datum line creation device 47 creates the datum line 51 the gradient θline of which is known, and the calibration work can be completed only by making the work implement 3 assume calibration postures by the number obtained by adding one for the intercept of the datum line 51 to the number of angle conversion parameters to be calibrated. Therefore, it is possible to greatly shorten calibration work time.

(4) In the second embodiment, the construction machine further includes, in addition to the features described in (2), a datum line creation device 47 that is attached to the vehicle main body 2 (upper swing structure 4) and creates a line having a predetermined gradient θ'line with respect to a horizontal plane as the datum line 51. The second work point position computing section 49*a* sets the predetermined gradient θ'line as a tilt (gradient) of the datum line 51, and calculates the second Zf coordinate of the work point 23 at each of the plurality of datum points from the equation indicating the line the tilt of which is set and from the first Xf coordinate of the work point 23 at each of the plurality of datum points calculated by the first work point position computing section 40*b*, the calibration value computing section 49*b* calculates the calibration value of the angle conversion parameter in such a manner that the evaluation equation F for the first Zf coordinate and the second Zf coordinate at the same datum point among the plurality of datum points is minimized, and the parameter update section 49*c* reflects the calibration value of the angle parameter calculated by the calibration value computing section 49*b* in computation by the angle computing section 40*a*.

In the construction machine configured as described above, the datum line creation device 47 is attached to the vehicle main body 2. Owing to this, it takes no labor to install the datum line creation device 47 on the construction site or the like and no labor to input the gradient of the datum line 51 to the calibration controller 45. Furthermore, the number of times of assuming the calibration posture is reduced by one from that according to the first embodiment. It is, therefore, possible to further shorten the calibration work time and further improve the work efficiency, compared with the first embodiment.

(5) In the third embodiment, the construction machine is featured, in addition to the features described in (2), in that the second work point position computing section 49*a* calculates the second Zf coordinate of the work point 23 at each of the plurality of datum points from the first Xf coordinate of the work point 23 at each of the plurality of datum points calculated by the first work point position computing section 40*b* and from the equation indicating the line, the calibration value computing section 49*b* calculates calibration values of an angle conversion parameter and a dimension parameter of a bucket 8 located at a tip end among the plurality of front implement members 6, 7, and 8, and a tilt and an intercept of the line in such a manner that the evaluation equation F for the first Zf coordinate and the second Zf coordinate at the same datum point among the plurality of datum points is minimized, and the parameter update section 49*c* reflects the calibration values of the angle parameter and the dimension parameter of the bucket 8 calculated by the calibration value computing section 49*b* in computation by the angle computing section 40*a* and the first work point position computing section 40*b*.

In the construction machine configured as described above, it takes no labor to acquire the gradient of the datum line 51 in advance, and the number of times of assuming the calibration posture is reduced by two from that according to the first embodiment. It is, therefore, possible to further shorten the calibration work time and further improve the work efficiency, compared with the first embodiment.

(6) Moreover, in each embodiment, the construction machine further includes, in addition to the features according to any one of (1) to (5), a display device 18 that displays output values (voltage values) from the plurality of angle sensors 25, 26, and 27 in all cases of actuating the work implement 3 in such a manner that the work point 23 is located at each of the plurality of datum points on the datum line 51.

By so configuring, it becomes easy to make the calibration postures entirely different from one another when the operator causes the work implement 3 to assume the calibration postures.

<Others>

The present invention is not limited to the above embodiments but encompasses various modifications without departing from the spirit of the invention. For example, the present invention is not limited to the construction machine that includes all the configurations described in the above embodiments but encompasses construction machines from which a part of the configurations is deleted. Furthermore, a part of the configurations according to some embodiment can be added to or can replace configurations according to the other embodiment.

While the bucket 8 is exemplarily described as the work tool in the above embodiments, the work tool other than the bucket 8 may be used.

In the above embodiments, the work implement 3 is configured with the boom 6, the arm 7, the bucket 8, and the boom cylinder 9, the arm cylinder 10, and the bucket cylinder 11 that drive the boom 6, the arm 7, the bucket 8. However, even when the number of constituent elements of the work implement 3 increases or decreases, calibration can be carried out as long as calibration postures equal to or greater, in number, than the parameters to be estimated are acquired.

While a case in which the center of the bucket claw tip 22 is set as the work point 23 is exemplarily described in the above embodiments, the work point may be set at an arbitrary point on any of the work tools (including the bucket 8).

In the above embodiments, the angle computed values θbm, θam, and θbk of the boom 6, the arm 7, and the bucket 8 are obtained from the first to third rotation angle sensors 25 to 27. Alternatively, a computation method by calculation of a link from a stroke length of a cylinder or a computation method using an absolute angle from a tilt sensor to the gravity may be used.

In the above embodiments, the linear equations are used for converting the analog signals detected by the first to third rotation angle sensors 25 to 27 into the angles and the conversion parameters α bm, βbm, αam, βam, αbk, and βbk are obtained. Alternatively, the calibration can be carried out using means other than the linear equations as long as the means is represented by a function of the analog signals to the angles and acquires the calibration postures equal to or greater, in number, than the parameters to be estimated.

In the above embodiments, even if the vehicle body dimension parameters such as the length Lbm of the boom 6 and the length Lam of the arm 7 are added to the parameters to be calibrated, the calibration can be carried out as long as the calibration postures equal to or greater, in number, than the parameters to be estimated are acquired.

In the above embodiments, it is described that the datum line creation device 47 can be installed at an arbitrary gradient and an arbitrary height. Alternatively, gradient and height ranges suited for the calibration may be described.

In the above embodiments, the evaluation function F between the work point position computed value and the datum line is created while attention is paid to the Zf coordinate. Alternatively, an evaluation function may be created while attention is paid to the Xf coordinate.

In the above embodiments, the steepest-descent method is exemplarily described as a scheme for deriving parameters for minimizing the evaluation function F by the nonlinear least-squares method. Alternatively, the other scheme such as the Newton's method may be used.

In the above embodiments, the evaluation function F minimized by the nonlinear least-squares method is exemplarily described as the residual square sum.

Alternatively, a sum of distances between points and lines or a standard deviation may be used.

In each of the above embodiments, the three controllers 31, 37 and 45 are mounted in the construction machine. Alternatively, all of or part of these controllers may be configured into an integral controller. Conversely, a configuration such that functions of the controllers 31, 37, and 45 are further divided and four or more controllers are mounted may be adopted.

Furthermore, in the description in each of the above embodiments, control lines or information lines considered to be necessary for the description are illustrated but all the control lines or the information lines related to products are not always illustrated. In actuality, it may be contemplated that almost all the configurations are mutually connected.

What is claimed is:

1. A construction machine comprising:

a vehicle main body;

a multijoint type work implement that is attached to the vehicle main body and configured with a plurality of front implement members;

a plurality of angle sensors that detect angles of the plurality of front implement members respectively; and a controller, the controller including:

an angle computing section that calculates angles of the plurality of front implement members on the basis of output signals from the plurality of angle sensors and angle conversion parameters; and a first work point position computing section that calculates a position of a work point arbitrarily set on the work implement on an operation plane of the work implement on the basis of the angles of the plurality of front implement members calculated by the angle computing section and dimension parameters of the plurality of front implement members, wherein:

when the work implement is actuated in such a manner that the work point is located at each of a plurality of positions on a linear datum line set on the operation plane, the first work point position computing section calculates a position of the work point at each of the plurality of positions; and the controller includes:

a calibration value computing section that calculates calibration values of the angle conversion parameters, the dimension parameters, and a parameter of the datum line on the basis of the positions of the work point at each of the plurality of positions calculated by the first work point position computing section; and a parameter update section that reflects the calibration values calculated by the calibration value computing section in computation by a corresponding computing section that is one of the angle computing section and the first work point position computing section.

2. The construction machine according to claim 1, wherein the operation plane is defined as an XZ plane, the first work point position computing section calculates first X coordinate values and first Z coordinate values of the work point at each of the plurality of positions on the datum line when the work implement is actuated in such a manner that the work point is located at each of the plurality of positions on the datum line, the controller further includes a second work point position computing section that calculates second Z coordinate values of the work point at each of the plurality of positions by inputting the first X coordinate values of the work point at each of the plurality of positions calculated by the first work point position computing section into an equation indicating the datum line, and the calibration value computing section calculates the calibration values of the angle conversion parameters, the dimension parameters, and the parameter of the datum line in such a manner that an evaluation value indicating a dissociation degree between the first Z coordinate values and the second Z coordinate values at a same position among the plurality of positions is minimized.

3. The construction machine according to claim 2, further comprising a tilt angle sensor that calculates a tilt angle of the vehicle main body with respect to a horizontal plane, wherein:

the second work point position computing section sets a difference between a gradient of the datum line with respect to the horizontal plane and the tilt angle as a tilt of the datum line, and calculates the second Z coordinate values of the work point at each of the plurality of positions from the equation indicating the datum line the tilt of which is set and from the first X coordinate values of the work point at each of the plurality of positions calculated by the first work point position computing section, the calibration value computing section calculates the calibration values of the angle conversion parameters and an intercept of the datum line in such a manner that the evaluation value for the first Z coordinate values and the second Z coordinate values at the same position among the plurality of positions is minimized, and the parameter update section reflects the calibration values of the angle parameters calculated by the calibration value computing section in computation by the angle computing section.

4. The construction machine according to claim 2, further comprising a datum line creation device that is attached to the construction machine and creates a datum line having a predetermined gradient with respect to a horizontal plane as the datum line, wherein the second work point position computing section sets the predetermined gradient as a tilt of the datum line, and calculates the second Z coordinate values of the work point at each of the plurality of positions from the equation indicating the datum line the tilt of which is set and from the first X coordinate values of the work point at each of the plurality of positions calculated by the first work point position computing section, the calibration value computing section calculates the calibration values of the angle conversion parameters in such a manner that the evaluation value for the first Z coordinate values and the second Z coordinate values at the same position among the plurality of positions is minimized, and the parameter update section reflects the calibration values of the angle parameters calculated by the calibration value computing section in computation by the angle computing section.

5. The construction machine according to claim 2, wherein the second work point position computing section calculates the second Z coordinate values of the work point at each of the plurality of positions from the first X coordinate values of the work point at each of the plurality of positions calculated by the first work point position computing section and from the equation indicating the datum line, the calibration value computing section calculates calibration values of an angle conversion parameter and a dimension parameter of a tip end front implement member located at a tip end among the plurality of front implement members, and a tilt and an intercept of the datum line in such a manner that the evaluation value for the first Z coordinate values and the second Z coordinate values at the same position among the plurality of positions is minimized, and the parameter update section reflects the calibration values of the angle parameter and the dimension parameter of the tip end front implement member calculated by the calibration value computing section in computation by the angle computing section and the first work point position computing section.

6. The construction machine according to claim 1, further comprising a display device that displays output values from the plurality of angle sensors in all cases of actuating the work implement in such a manner that the work point is located at each of the plurality of positions on the datum line.

* * * * *